United States Patent [19]

Vorhauer

[11] Patent Number: 4,498,274

[45] Date of Patent: Feb. 12, 1985

[54] DEVICE FOR SUPPLYING AND FOR BRINGING TOGETHER A WEB OF PACKAGING MATERIAL AND A TEAR STRIP WEB

[75] Inventor: Hans Vorhauer, Schwelm, Fed. Rep. of Germany

[73] Assignee: Maschinenfabrik Alfred Schmermund GmbH & Co., Gevelsberg, Fed. Rep. of Germany

[21] Appl. No.: 387,446

[22] Filed: Jun. 11, 1982

[30] Foreign Application Priority Data

Jun. 13, 1981 [DE] Fed. Rep. of Germany ..... 3123544

[51] Int. Cl.[3] ..... B65B 61/18

[52] U.S. Cl. ..... 53/412; 53/133; 493/377; 493/930; 493/963

[58] Field of Search ..... 493/212, 377, 930, 923, 493/963; 53/133, 412; 242/206, 192, 55

[56] References Cited

U.S. PATENT DOCUMENTS

| | | | |
|---|---|---|---|
| 2,334,381 | 11/1943 | Bronander | 493/930 X |
| 2,683,401 | 7/1954 | Smith | 493/963 X |
| 3,259,031 | 7/1966 | Paulson | 493/923 X |
| 3,345,918 | 10/1967 | Simeone | 493/377 X |
| 4,208,932 | 6/1980 | Anderson | 493/377 X |
| 4,226,386 | 10/1980 | Rubi | 242/192 |

*Primary Examiner*—James F. Coan

[57] ABSTRACT

A tear strip is caused to move synchronously with a moving web of packaging material and the web and strip are brought into contact for subsequent joining to define a packaging material with integral tear strip. Contact between the packaging material and tear strip is effected at the surface of a rotating feed roller and a friction drive is employed to cause a supply reel for the tear strip to rotate synchronously with the feed roller.

10 Claims, 1 Drawing Figure

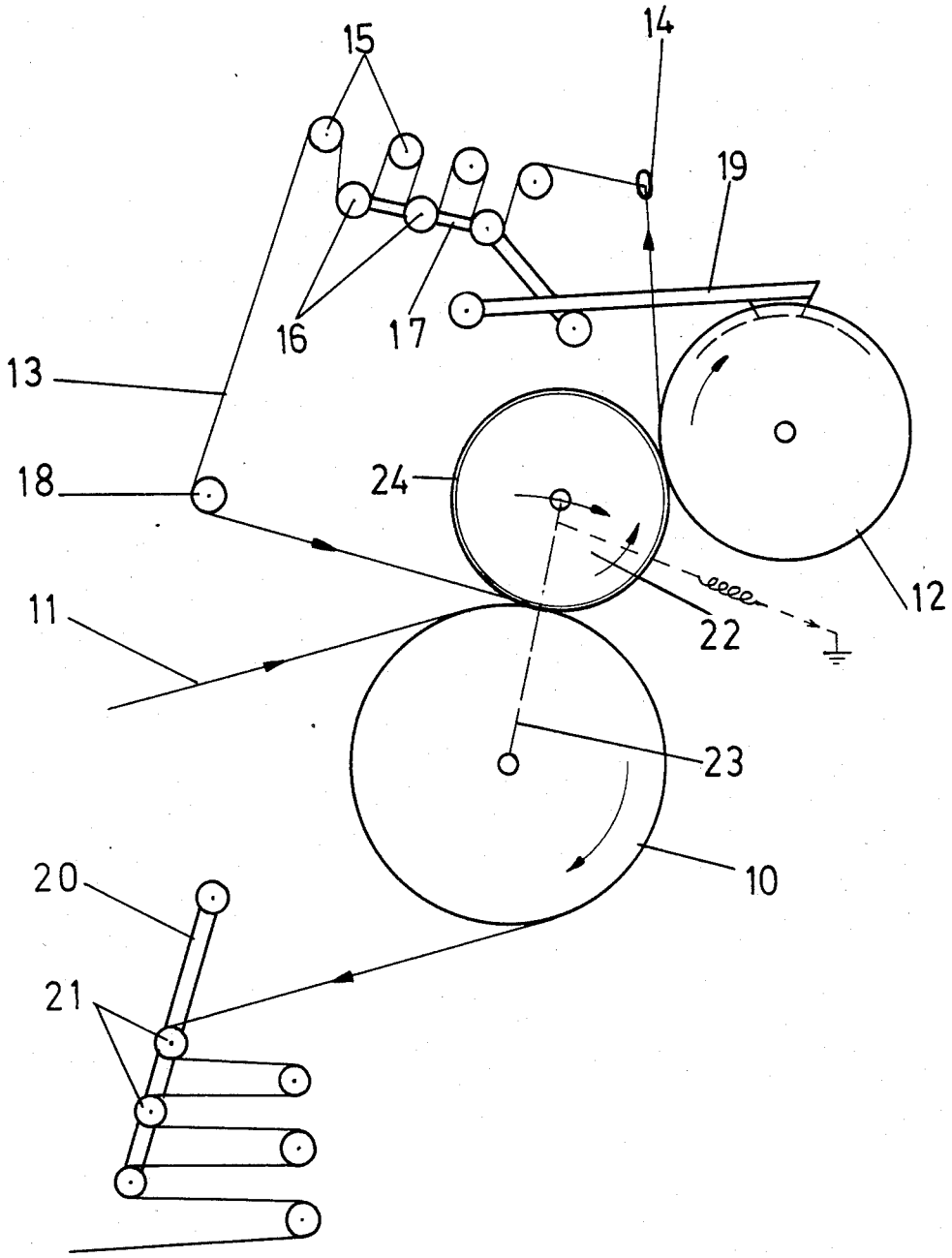
15
14
19
16
17
13
18
24
12
22
11
23
10
20
21

DEVICE FOR SUPPLYING AND FOR BRINGING TOGETHER A WEB OF PACKAGING MATERIAL AND A TEAR STRIP WEB

TECHNICAL FIELD

The present invention relates to packaging and particularly to the production of packaging material comprising a cover sheet having a tear strip associated therewith. More specifically, this invention is directed to apparatus for simultaneously supplying, from separate storage reels, a sheet of packaging material and a web of material which will function, in a package to be formed from the combined web and sheet, as a tear strip. Accordingly, the general objects of the present invention are to provide novel and improved methods and apparatus of such character.

BACKGROUND ART

While not limited thereto in its utility, the present invention is particularly useful in the packaging of consumer products and particularly products which are packaged within a wrapper comprised of paper. Such packages, cigarette packets for example, are frequently provided with a thin transparent outer wrapping which may be opened by pulling on a tear strip. This outer wrapping may be comprised of cellophane. In the course of forming the package a tear strip is mated with a moving web of cellophane film, the tear strip and film then being welded together to form a wrapper which is thereafter used to envelope the cigarette packet or other package.

The mating of two moving webs, i.e., a packaging film and a tear strip, presents problems of long-standing in the art. Any departure from synchronism will produce curling and shrinkage during the welding of the tear strip to the packaging film. Such departures from synchronous movement are particularly likely to occur during starting and braking or stopping of the downstream packaging machine because there is a tendency to stretch the tear strip during such speed changes. The foregoing is also true when the supply speed of the packaging film and tear strip must be changed to accommodate the mode of operation of the packaging machine.

DISCLOSURE OF THE INVENTION

The present invention overcomes the above-discussed and other deficiencies and disadvantages of the prior art by providing apparatus for supplying and bringing together a web of packaging material and a tear strip in a completely synchronized manner. The present invention also encompasses the method of operation of the aforesaid apparatus wherein a tear strip is fed into contact with a moving film of packaging material so that, at the time contact is established, both materials are moving at the same speed.

Apparatus in accordance with the present invention includes means for simultaneously supplying, and bringing into contact with one another, a web of packaging material and a tear strip, the packaging material and tear strip being withdrawn from supply reels or bobbins. The packaging material and tear strip are brought into contact at the periphery of a feed roller. Means are provided whereby this feed roller functions as the drive for the supply bobbin for the tear strip. In accordance with a preferred embodiment the tear strip supply bobbin drive comprises a further, i.e., an intermediate drive, roller which is frictionally engaged by the feed roller and the outer periphery of the tear strip supply bobbin.

In accordance with a preferred embodiment, in addition to employing the feed roll on which the tear strip and packaging material are brought into contact to drive the tear strip supply bobbin through an intermediate drive roller, the apparatus is also provided with a means for subjecting the tear strip to a predetermined tension and for braking the supply bobbin should, for example, the tear strip break or the supply thereof be exhausted.

BRIEF DESCRIPTION OF DRAWING

The present invention may be better understood and its numerous objects and advantages will become apparent to those skilled in the art by reference to the accompanying drawing which is a schematic diagram of apparatus in accordance with a preferred embodiment of the invention.

BEST MODE OF CARRYING OUT THE INVENTION

With reference now to the drawing, a main feed roller is indicated at 10. Roller 10 will be supported by means of a machine frame, not shown. A sheet or web 11 of packaging material, cellophane, for example, is supplied to feed roller 10 from a bobbin or supply reel, not shown. A tear strip 13 is withdrawn from a supply reel or bobbin 12 and also delivered to roller 10. Thus, the tear strip and packaging film are brought together at the surface of roller 10 and must, for the reasons described above, be moving in synchronism at the time they are brought into contact.

The tear strip withdrawn from bobbin 12 is first passed through a guide ring 14 and then caused to alternately pass over a series of fixed position rolls 15 and rolls 16 of a pendulum mechanism 17. After passing over the last of the fixed rolls 15, the tear strip passes about a guide roller 18 before being directed into contact with the packaging film 11. The pendulum mechanism 17 is employed to impart a predetermined tension to the tear strip web and thus the rolls 16 are, as shown, positioned generally below the fixed position rolls 15.

The apparatus shown in the drawing also includes a brake 19 which will automatically arrest the movement of the bobbin 12 in the case of an interruption of the supply of the tear strip web 13. The brake 19 is thus used during normal shut-off of the apparatus or in the case of a brake of the web 13. Should web 13 part, the pendulum 17 will actuate brake 19, the deflection of the pendulum being comparatively large should the rolls 16 no longer be contacted by the tear strip web. It is to be noted that the supply for the packaging material web 11 may also be provided with pendulum and brake mechanisms.

The webs 11 and 13, after having been brought into contact at the surface of feed roll 10, are delivered to a further pendulum mechanism 20 which includes rollers 21.

A drive wheel 22 for bobbin 12 is positioned between the bobbin and the feed roller 10. The drive wheel 22 is in frictional engagement with the feed roller 10 and with a portion of the bobbin 12 assembly. In the disclosed embodiment the drive wheel 22 is supported for rotation, for example by means of swivel arms 23, from the axle of feed roller 10 and is loaded by gravity against the periphery of bobbin 12. Accordingly, the force exerted by drive wheel 22 on the periphery of bobbin 12 is independent of the quantity of material on bobbin 12. This arrangement results in the synchronous supply of both of webs 11 and 13 during starting, braking and speed changes and thus insures that, during the welding of web 13 to web 11, no curling or shrinkage of the tear strip, which otherwise would have resulted from the stretching of the tear strip prior to its reaching feed roller 10 and by the contraction thereof after leaving feed roller 10, will occur.

In order to obtain the desired frictional engagement of drive wheel 22 with bobbin 12 the drive wheel may, for example, be provided with a coating 24 of a soft flexible material such as a foam. Also, if deemed necessary, the force exerted by the drive wheel against the periphery of bobbin 12 can be increased by loading of the swivel arms 23. The drive wheel 22 may also be spring loaded against bobbin 12 rather than merely acting on the bobbin under the influence of gravity. Further, drive wheel 22 does not have to be in direct engagement with the periphery of feed roller 10, as depicted in the drawing, but may alternatively be in frictional engagement with a separate element which rotates synchronously with feed roller 10.

While a preferred embodiment has been shown and described, various modifications and substitutions may be made thereto without departing from the spirit and scope of the invention. Accordingly, it is to be understood that the present invention has been described by way of illustration and not limitation.

I claim:

1. A method of mating a moving film of packaging material and a tear strip which is to be applied thereto comprising:

passing the film over a feed roller;

withdrawing the tear strip from a supply reel;

applying a preselected degree of tension to the tear strip;

bringing the tear strip into contact with the surface of the film at the periphery of the feed roller; and loading a drive wheel against the tear strip supply reel and the feed roller whereby the supply reel will be coupled to the feed roller by the drive wheel and rotate in synchronism with the feed roller.

2. Apparatus for mating a tear strip with a moving sheet of packaging material comprising:

a rotating feed roll, the sheet of packaging material being passed about said feed roll;

a rotatable supply reel for the tear strip; and drive wheel means, said drive wheel means rotating synchronously with said feed roll, said drive wheel means being in frictional engagement with the periphery of said tear strip supply reel and being frictionally coupled to said feed roll whereby rotational motion of said feed roll will be transmitted to said supply reel via said drive wheel means and said supply reel will rotate synchronously with said feed roll.

3. The apparatus of claim 2 wherein said drive wheel is urged against said feed roll and supply reel by gravity.

4. The apparatus of claim 2 wherein said drive wheel is provided with a resilient coating.

5. The apparatus of claim 4 wherein said coating is comprised of a foam material.

6. The apparatus of claim 5 wherein said drive wheel is in frictional engagement with said feed roll.

7. The apparatus of claim 6 wherein said drive wheel is urged against said feed roll and supply wheel by gravity.

8. The apparatus of claim 2 further comprising: means for resiliently biasing said drive wheel against said feed roll and the outer periphery of said supply reel.

9. Apparatus for mating a tear strip with a moving sheet of packaging material comprising:

a rotating feed roll, the sheet of packaging material being passed about said feed roll;

a rotatable supply reel for the tear strip; and drive wheel means, said drive wheel means being urged against said supply reel and toward said feed roll by gravity, said drive wheel means being in frictional engagement with the periphery of said tear strip supply reel and being caused to rotate synchronously with said feed roll whereby said supply reel will rotate synchronously with said feed roll.

10. The apparatus of claim 9 further comprising: means for resiliently biasing said drive wheel toward said feed roll and against the outer periphery of said supply reel.

* * * * *